United States Patent [19]

Katz et al.

[11] 4,149,813

[45] Apr. 17, 1979

[54] MECHANICAL PENCIL WITH AUTOMATIC AND MANUAL LEAD ADVANCE

[75] Inventors: Otto Katz, Schwabach; Günter Edel, Fürth, both of Fed. Rep. of Germany

[73] Assignee: A. W. Faber-Castell, Nürnberg, Fed. Rep. of Germany

[21] Appl. No.: 778,317

[22] Filed: Mar. 16, 1977

[30] Foreign Application Priority Data

Mar. 19, 1976 [DE] Fed. Rep. of Germany ..... 2611608

[51] Int. Cl.[2] ..... B43K 21/16

[52] U.S. Cl. ..... 401/65; 401/67

[58] Field of Search ..... 401/55, 57, 65, 67, 401/85, 87

[56] References Cited

U.S. PATENT DOCUMENTS

| | | | |
|---|---|---|---|
| 1,033,529 | 6/1927 | Hoffman | 401/65 |
| 1,644,740 | 10/1927 | Morlock | 401/65 |
| 3,850,531 | 11/1974 | Aukermann | 401/65 |
| 3,899,256 | 8/1975 | Mitsuyg | 401/65 |
| 4,003,664 | 1/1977 | Butkg | 401/67 |

*Primary Examiner*—Edward M. Coven
*Attorney, Agent, or Firm*—Michael J. Striker

[57] ABSTRACT

A mechanical pencil has an axially elongated hollow pencil body in which is slidable a tubular seat member. A lead-protecting sleeve is axially displaceable in the pencil body between a front position and a rear position and is urged into the front position with a relatively strong spring force. At least two jaws are axially displaceable on the seat and are moved radially closer as they move backwardly from the tip so as to grip a lead that projects backwardly from the lead-projecting sleeve. A relatively weak spring urges these jaws backwardly in the seat. An O-ring is provided in the lead-projecting sleeve so that each time the pencil tip is lifted from the writing surface the lead is automatically pulled forwardly by the strong spring force through the jaws. Similarly forward displacement of the seat in which the jaws rest allows for manual advance of a lead gripped by the jaws and passing through the lead-protecting sleeve.

26 Claims, 4 Drawing Figures

MECHANICAL PENCIL WITH AUTOMATIC AND MANUAL LEAD ADVANCE

BACKGROUND OF THE INVENTION

The present invention relates to a mechanical pencil. More particularly this invention concerns such a pencil with automatic lead advance.

A mechanical pencil is known having a lead-protecting sleeve which surrounds the portion of the lead projecting from the tip of the pencil. This sleeve serves to support a relatively thin lead, by which is meant here any rod or stick of writing material used by the mechanical pencil, and prevents it from breaking. As the lead wears away the protecting sleeve automatically slides back into the body of the pencil. When insufficient lead is projecting from the tip, even with a fully retracted lead-protecting sleeve, the user actuates the lead-advance button at the rear end of the pencil so as to incrementally advance the lead another step. Thus writing can continue with the newly-exposed portion of lead, around which the protecting sleeve has also automatically been advanced.

It has been suggested to combine this protecting-sleeve structure with an automatic lead-feed mechanism inside the pencil. In such an arrangement the protecting sleeve is spring-biased forwardly, that is away from the rear or eraser end of the pencil and toward the writing tip thereof. The lead projecting from the pencil tip is held in a standard slitted collet-like holder which is spring biased not into a position clamping the lead as is usual, but into a position allowing displacement of the lead relative to the holder. This holder is tapered away from the tip of the pencil and is limitedly longitudinally displaceable in the pencil. Thus when the tip of the pencil is pressed against the paper the lead is pushed backwardly, frictionally engaging the holder and forcing it into the seat so as tightly to clamp the lead in place. When this backwardly effective writing pressure is let up the arrangement automatically steps the lead forward a tiny increment.

The main difficulty with such an arrangement is that the backward displacement of the lead each time it is brought into contact with the writing paper or the like is relatively great. Thus each time the pencil is brought into contact with the paper the lead must be depressed a certain distance before writing can commence. Such action interferes with neat writing and, indeed, makes it impossible for some persons to write legibly with such a pencil. Another disadvantage with this type of arrangement is that it is necessary, in case the lead breaks or a new lead must be fed to the tip, to repeatedly press the tip of the pencil against the page in order to feed a new lead to it. Due to the smallness of the increments by which the lead is advanced during such feed, it is therefore necessary for the pencil user to press down many times in order to feed a new lead to the tip.

SUMMARY OF THE INVENTION

It is therefore an object of the present invention to provide an improved mechanical pencil.

Another object is to provide such a pencil which automatically advances the lead to the writing tip as the pencil is used.

Yet another object is the provision of an improved mechanical pencil wherein it is possible manually and rapidly to advance a lead to the writing tip.

Yet another object is to provide a mechanical pencil of the automatic-advance type wherein the lead is not depressed perceptibly as it is brought into engagement with a writing surface or the like.

These objects are attained according to the present invention in an arrangement wherein a lead-protective sleeve is urged from a back position to a front position extending from the writing tip by means of a relatively strong spring. Furthermore, a pair of lead-gripping jaws are engaged with a seat in the pencil and are pressed backwardly away from this seat by a relatively weak spring. In accordance with this invention the two jaws are longitudinally displaceable and have outer surfaces at the seat in the pencil body and inner lead-gripping faces transversely and frictionally engageable with the lead projecting rearwardly from a longitudinally throughgoing passage through the lead-protecting sleeve. Either the seat is tapered away from the tip or the jaws are tapered away from the tip so that as the jaws are displaced backwardly into the seat the transverse clamping force exerted by them on a lead gripped between their inner faces increases, and when they are moved forwardly this clamping force decreases. Thus when a lead is frictionally engaged in the sleeve and between the faces of the jaws and the sleeve is in the back position the relatively strong force exerted by the relatively stiff spring overcomes the relatively weak force of the relatively weak spring and forwardly displaces the lead-protecting sleeve, the lead engaged therein, and the jaws. During such action the jaws are pulled slightly forwardly in the seat so that they effectively release the lead gripped between them.

In accordance with further features of this invention the lead-protecting sleeve is provided with means in the form of an elastomeric ring surrounding its throughgoing passage for frictionally engaging a lead in the sleeve for joint longitudinal displacement of the sleeve and this lead.

According to further features of this invention the pencil has a rearwardly projecting lead-storage tube covered by a removable cap and forming a lead-storage compartment adapted to hold the supply of leads. The front end of this tube is formed as a plug received in an annular or tubular member forming the seat. An elastomeric ring couples this plug with the seat and the jaws frictionally engage the seat by means of rollers. The frictional force between the plug and the seat is much greater than that between the rollers and the seat. The member forming the seat is longitudinally displaceable so that when the lead-storage tube is depressed first of all the entire seat will move from a rearward to a forward position. Once in this forward position the seat will stop and the plug will continue to move forwardly. As the entire seat moves forwardly the lead is pushed forwardly through the protective sleeve.

According to yet another feature of this invention the front end of the plug and the rear end of a rear end portion of the lead-protecting sleeve are formed as points engageable in correspondingly longitudinally open recesses formed by the jaws. Thus once the plug is moved all the way forwardly the jaws are forced apart to free the lead for further advance, and to allow a fresh lead to drop down between these jaws into the sleeve to the level of the braking spring therein.

The relatively weak spring urging the jaws backwardly also, according to this invention, biases the jaw radially or transversely apart. This insures that a fresh lead can be loaded into an empty pencil with relative ease, dropping all the way down into the protective sleeve through the open jaws.

Thus the pencil according to the present invention has all of the advantages of a pencil with automatic lead advance. Each time the pencil is brought into contact with a writing surface or the like an indetectable backward displacement of the lead will take place. At the same time it is possible relatively easily and rapidly to manually feed a lead to the tip of the pencil. The mechanical pencil is relatively simple in operation and can be produced at low cost. Furthermore the use of the protective sleeve allows a relatively thin lead, even down to a diameter of 0.3 mm, to be used.

The novel features which are considered as characteristic for the invention are set forth in particular in the appended claims. The invention itself, however, both as to its construction and its method of operation, together with additional objects and advantages thereof, will be best understood from the following description of a specific embodiment when read in connection with the accompanying drawings.

DESCRIPTION OF A PREFERRED EMBODIMENT

Figure 1:
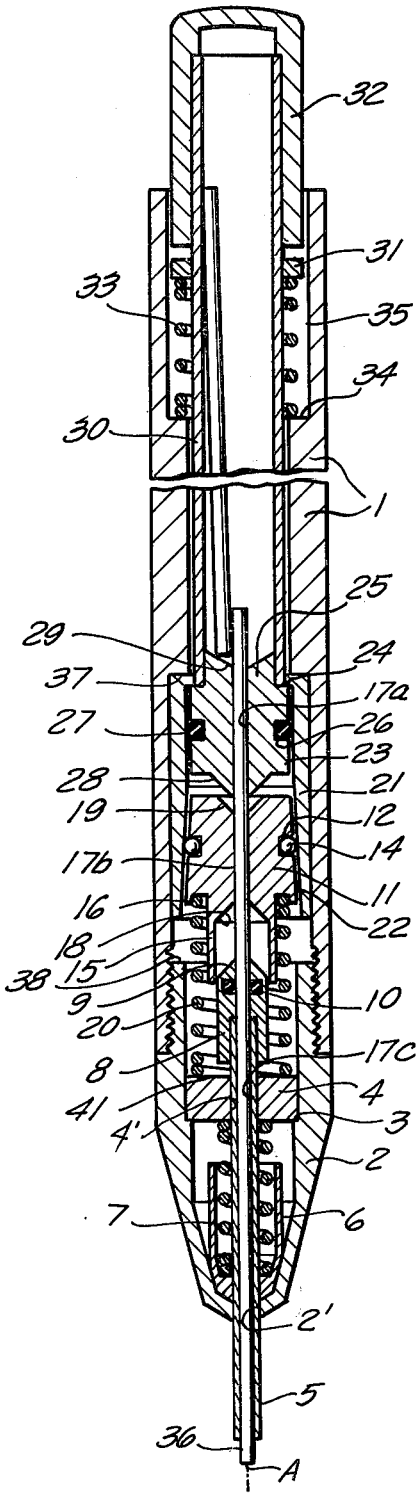
FIG. 1 is an axial longitudinal section through the writing instrument according to this invention in the normal use position.
Figure 2:
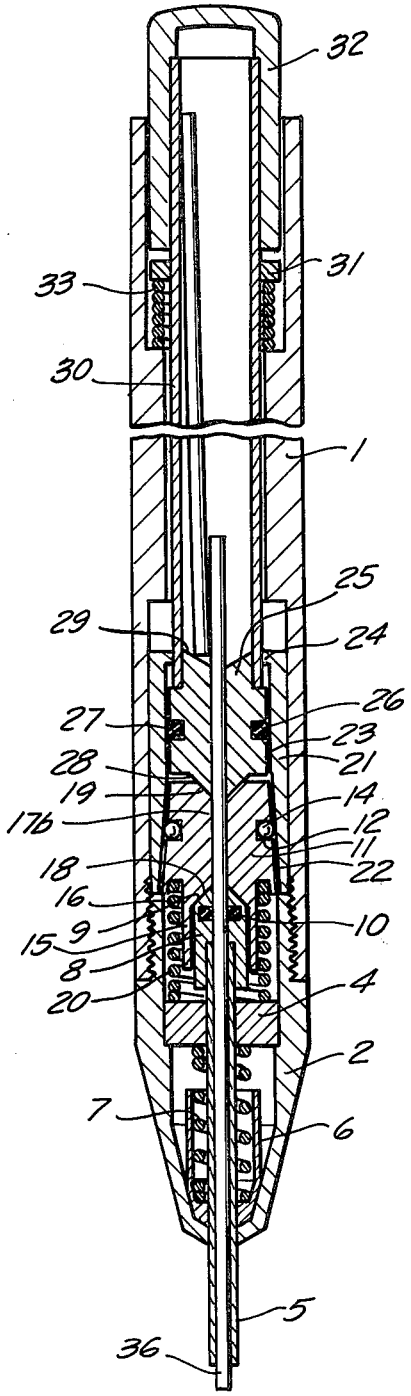
FIG. 2 is a view similar to FIG. 1 showing the writing instrument during manual lead advance.
Figure 3:
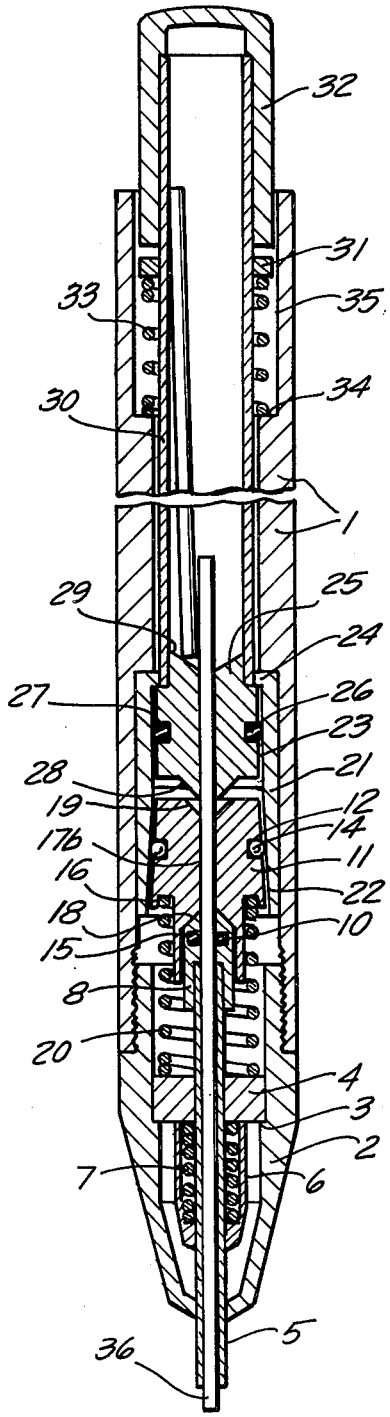
FIG. 3 is a view similar to FIG. 1 showing the writing instrument during automatic lead advance.

As shown in FIG. 1 a mechanical pencil has a tubular and a generally cylindrical body 1 defining an axis A and to the front end of which is threaded a forwardly pointed tip piece 2 formed with an axially throughgoing hole 2'. Resting on a shoulder 3 formed in the hollow interior of the body 1 is an annular rigid washer 4 having a central axially throughgoing hole 4'. A lead-protecting sleeve 5 is axially slidable in the two holes 2' and 4' of the members 2 and 4 and normally projects axially from the tip 2 as shown in FIG. 1. A backwardly open cup 6 is fixed to the sleeve 5 and displaceable between the abutments formed by the members 4 and 2 so as to define for the sleeve 5 a front position as shown in FIGS. 1 and 2 and a back position as shown in FIG. 3. A relatively strong compression spring 7 bears at its front end on the cup 6 in which it is partially received and at its rear end on the front face of the abutment washer 4 so as normally to urge the sleeve 5 into the front position with a relatively strong spring force.

Fitted on to the rear end of the sleeve 5 is a generally cylindrical body 8 itself having a rear end 9 formed as a rearwardly pointed frustoconical surface. This body 8 is provided immediately in front of its rearmost portion with an annular elastomeric ring 10. The sleeve 5 and the body 8 together form a frontmost bore or passage **17*c* which is of cylindrical shape and of the same or slightly greater diameter than the outside diameter of a lead 36. The inner peripheral diameter of the ring 10 is somewhat smaller than the outside diameter of the lead 36 so that this ring 10 frictionally longitudinally couples the sleeve 5 and lead 36** together.

Figure 4:
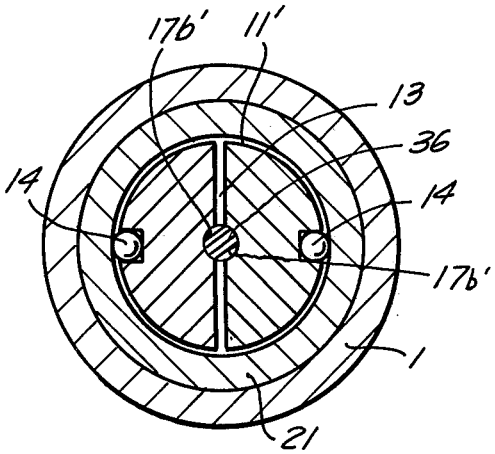
FIG. 4 is a cross-section through the writing instrument shown in FIGS. 1–3.

As also shown in FIG. 4 a pair of like generally semi-cylindrical jaws 11 are formed with outer surfaces 11' of generally cylindrical or slightly frustoconical shape and have planar and axially extending facing inner faces 13 each formed with a respective cylindrical recess **17*b'*. When a lead 36 is engaged in the recesses 17*b'*, that together form an intermediate passage section 17*b*, the faces 13** are spaced radially slightly apart.

Each of the outer surfaces 11' is formed with a respective radially open pocket 12 in which is provided a rolling element constituted as a ball 14. These pockets 12 are diametrically opposite each other and lie in a common plane perpendicular to the faces 13. A seat member or tube 21 is axially displaceable in the body 1 between a rearward position shown in FIG. 1 and having its rear end resting against a shoulder 37 formed in the tube 1 and a forward position shown in FIG. 2 with its front end resting against the rear end 38 of the tip 2. The forward internal portion 22 of this seat member 21 is of frustoconical shape and of the same taper as the outer surfaces 11' of the jaws 11. The rearward portion 23 of the inner surface of the member 21 is a cylindrical extension of the rear end of the frustoconical portion 22.

A plug or coupling piece 25 formed with a rear bore section **17*a* is provided in this rear section 23 and has an outwardly open circumferential groove 26 in which is provided an elastomeric ring 27 that frictionally tightly engages the surface 23. This element 25 is displaceable from a rearward position shown in FIG. 1 resting against an inwardly directed lip 24 formed on the rear end of the tube 21 and a forward position engaging the jaws 11 shown in FIG. 2. This plug 25 is fixed on the front end of a lead-storage tube 30 and is formed at its rear face with a frustoconical recess 29 forming a lead-receiving funnel. A removable cap 32 is engaged over the rear end of the tube 30, and a spring 33 engages between a shoulder 34 formed in the body 1 and a rim or ring 31 fixed to the tube 30 to urge it away from the tip 2 and, therefore, urge the plug 25 into engagement with the rim 24**.

At its front end the plug 25 is formed around the passage **17*a* with a frustoconical projection 28 engageable in a corresponding but backwardly open frustoconical recess 19 formed by the jaws 11. Similarly the jaws 11 are formed at their front ends with a forwardly open frustoconical recess 18 that is snugly fittable with the frustoconical rear end 9 of the element 8. These jaws 11 are formed with semi-cylindrical extensions 15 at their front ends around which the spring 20 engages, and are also formed spaced radially outwardly from these extensions 15 with semi-circular ridges 16. The rear end of the spring 20 engages in the groove formed between the formation 15 and 16 and presses radially outwardly against the formation 16 so as to urge the jaws 11** apart.

The mechanical pencil described above is used as follows:

The cap 32 is removed from the lead-storage tube 30 and a supply of lead 36 is dropped therein, whereupon the cap 32 is replaced. The pencil is then held with the axis A extending generally vertically and the tip down. One of the leads 36 will then automatically find its way into the bore section **17*a* and will drop down through this section 17*a* until its forward end comes to rest on the rear surfaces of the two jaws 11, whose faces 13 will flatly engage one another so that the passage 17*b*** will be too small to admit the lead.

The cap 32 is then pressed forwardly. This action moves the tube 30 forwardly and, to start with, presses the plug 25 down in the body 1. The frictional engagement between the plug 25 and the sleeve 21 via the element 26 is considerable, in fact greater than the rearwardly effective spring force of the spring 20. Thus the seat element 21 will be displaced away from the shoulder 37 until it contacts the end surface 38. Further forward displacement of the tube 30 and plug 25 will therefore slide the plug 25 axially forwardly in the element 21 until its pointed projection 28 engages in the backwardly flared recess 19 between the jaws 11. This will first of all move these jaws 11 apart and will thereafter press these jaws 11 forwardly until the pointed projection 9 fits into the recess 18. The two points 9 and 28 engaging in the two recesses 18 and 19 will force the jaws 11 radially apart and open up the passage **17*b* formed thereby sufficiently for the lead 36 engaged in the passage 17*a* to drop further down between these jaws 11 into the rear end of the sleeve 5. Since the element 10 is of smaller internal diameter than the lead 36 it will not be possible for this lead 36 of its own weight to pass through the ring 10**.

Thereafter the user releases the button 32 so that the sleeve 30 and plug 25 will move backwardly due to the force of the spring 33, entraining the seat member 21 and allowing the spring 20 to push the jaws 11 back. Before the jaws 11 lock on and clamp the lead 36 they will, however, move backwardly somewhat along this lead 36 so that a short length of the lead 36 will be left projecting forwardly from the front end of the jaws 11 at the recess 16. This action is insured due to the considerable frictional engagement of the plug 25 with the tube 21 so that the formations 19 and 28 will remain together, and due to the outward spring force by the rear end of the spring 20.

Renewed depression of the cap 32 will first of all move the plug 25 and sleeve 21 forwardly as described above due to the strong frictional engagement at the O-ring 26. Since the jaws 11 are now fitted into the seat portion 22 this will cause the lead 36 to be forced forwardly through the O-ring 10 and partially down into the tube 5. Releasing of the cap 32 will allow the jaws 11 and plug 25 to move backwardly as described above, with the front end of the lead 36 engaged in the ring 10 and snugly held thereby.

Thereafter continued actuations of the button 32 will axially advance the lead 36 through the tube 5 until it projects from the forward end thereof as shown in FIG. 1. The mechanical pencil can then be used to write.

Thereafter as the lead 36 wears down at its front end the sliding sleeve 5 will move backwardly. This backwardly effective writing force is transmitted via the ring 10 (the inner peripheral diameter of the ring 10 is somewhat smaller than the outside diameter of the lead 36 so that this ring 10 frictionally longitudinally couples the sleeve 5 and lead 36 together) to the sleeve 5 and displaces it backwardly. It is also frictionally transmitted via the recesses **17*b*' to the jaws 11 and is not able to move them backwardly appreciably, since the tiniest bit of backward motion will merely wedge these jaws 11 more tightly in the frustoconical seat portion 22 and clamp them the more tightly on the lead 36. In fact the backward depression of the lead 36** during use is almost imperceptible.

On the contrary even extremely slight backward depression of the lead 36 which has no effect on the use of the writing instrument does slightly backwardly displace the sleeve 5. Since the spring force of the spring 7 is considerably greater than the spring force of the spring 20, once the tip of the pencil is lifted from the paper the spring 7 will push the sleeve 5 forwardly. Such a forward displacement will not have the wedging action on the jaws 11 as described above, but instead will tend to move the jaws 11 slightly forwardly, thereby decreasing the clamping pressure and slightly compressing the spring 20. For this reason the lead 36 will slip slightly forwardly between the jaws 11 and will assume a new incrementally advanced position that compensates for wearing-off of the writing tip of the lead 36. Such action will take place automatically until the lead is completely used up, and since the sleeve 30 contains another lead 36 the supply is automatically replenished.

It is noted in the above that the frictional engagement between the plug 25 and the element 21 via the element 26 is relatively great, much greater than the frictional engagement between the jaws 11 and the element 21 by means of the balls 14. This insures that the jaws 11 are displaced before the plug 25. Similarly the spring 20 is much less stiff than the spring 7 so that the spring 7 can forwardly displace the jaws slightly as necessary in order to automatically advance the lead.

Thus with the mechanical pencil according to the present invention the user need never manually advance the lead until the entire supply is used up under normal circumstances. When the pencil must be reloaded with more lead or with lead of a different color, however, it is a relatively easy matter for the user to quickly manually advance a new lead through the pencil. Similarly when the cap 32 is depressed it is possible for a lead of an undesired color or quality to be manually withdrawn from the tip 2. It is possible to write very neatly with such a pencil, since the depression of the lead 36 as it is brought into contact with the writing surface is only that which is necessary to compensate for the play in the pencil. Since the parts are relatively small and formed with great accuracy compensation of such play requires almost imperceptible displacement.

It will be understood that each of the elements described above, or two or more together, may also find a useful application in other types of structures differing from the types described above.

While the invention has been illustrated and described as embodied in a mechanical pencil, it is not intended to be limited to the details shown, since various modifications and structural changes may be made without departing in any way from the spirit of the present invention.

Without further analysis, the foregoing will so fully reveal the gist of the present invention that others can by applying current knowledge readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A mechanical pencil, comprising a longitudinally elongated at least partially hollow pencil body having a forward tip and provided internally with a seat having a seat surface spaced longitudinally backwardly from said tip; a lead-protecting sleeve longitudinally displaceable in said body between a front position relatively far from said seat and a back position relatively close to said seat, said sleeve having a longitudinally throughgoing passage dimensioned to receive a pencil lead; means for urging said sleeve forwardly into said front position with a relatively strong force; means in said sleeve frictionally engaging a lead therein for joint longitudinal displacement of said sleeve and a lead therein; at least two longitudinally displaceable jaws having outer surfaces at said seat and inner lead-gripping faces transversely and frictionally engageable with a lead projecting from said sleeve, at least one of said surfaces being so inclined that the two surfaces together converge in the backward direction toward said seat, whereby the transverse clamping force exerted by said jaws on a lead gripped between said faces increases as said jaws are moved backwardly towards said seat and decreases as said jaws are moved forwardly from said seat; and means urging said jaws backwardly in said seat with a relatively weak force, whereby when a lead is frictionally engaged in said sleeve and between said faces and said sleeve is in said back position said strong force can overcome said weak force and forwardly displace said sleeve, the lead engaged therein, and said jaws.

2. The pencil defined in claim 1, further comprising means for displacing said jaws independently of said sleeve longitudinally between a rearward position relatively close to said seat and a forward position relatively far from said seat, so that displacement of said jaws towards said forward position urges said lead gripped between said faces through said sleeve when said sleeve is in said front position.

3. The pencil defined in claim 2, wherein said displacing means comprise a hollow jacket having an outer circumferential surface movably engaged the inside surface of said body and an inside surface bounding a passage operative for movably receiving therein said jaws.

4. The pencil defined in claim 3, wherein said inner surface of said jacket has a conical cross-section converging in direction away from said tip of the body.

5. The pencil defined in claim 1, wherein said means with said strong force is a relatively strong spring braced between said body and said sleeve and said means with said weak force is a relatively weak spring braced between said jaws and said body.

6. The pencil defined in claim 1, wherein each of said jaws is formed at its respective inner face with a longitudinally extending lead-receiving inner recess and on its respective outer surface with an outwardly and transversely open outer recess, said pencil further comprising a rolling element in each of said outer recesses rollingly engaging said surface of said seat.

7. The pencil defined in claim 6, wherein said rolling elements are balls.

8. The pencil defined in claim 6, wherein when a lead is gripped in said inner recesses, said inner faces are spaced transversely apart and are out of contact with each other.

9. The pencil defined in claim 5, wherein said housing includes a tube longitudinally connected to said jacket and longitudinally displaceable between a rearward position relatively far from said tip and a forward position relatively close to said tip, said pencil further comprising a spring braced between said body and said tube and urging same into said rearward position.

10. The pencil defined in claim 9, wherein said jaws together form a tubular forwardly projecting extension receiving said sleeve and surrounded by said weak spring.

11. The pencil defined in claim 9, wherein said sleeve is formed with a backwardly pointed end engageable between said jaws to force said jaws apart on longitudinal engagement therewith.

12. The pencil defined in claim 11, wherein said jaws form a region of the same taper as said backward pointed end.

13. The pencil defined in claim 9, wherein said means in said sleeve frictionally engaging a lead therein is an elastomeric ring in said sleeve surrounding said passage adjacent said jacket.

14. The pencil defined in claim 13, wherein said sleeve includes a rear end portion formed with a rearwardly pointed end and carrying said elastomeric ring.

15. The pencil defined in claim 14, wherein said sleeve includes a tube and said rear end portion is press-fitted therein.

16. The pencil defined in claim 9, wherein said sleeve projects longitudinally forwardly from said tip.

17. The pencil defined in claim 9, wherein said strong spring is stiffer than said weak spring.

18. The pencil defined in claim 17, wherein said means in said sleeve frictionally engaging a lead therein engages such lead with a force sufficient to couple said sleeve and such lead for joint longitudinal displacement and compression of said weak spring, whereby said weak force is insufficient to longitudinally displace a lead in said sleeve relative to said means frictionally engaging.

19. The pencil defined in claim 9, wherein said jaws form at said inner faces a backwardly open and flaring recess, said tube carrying a forwardly pointed formation engageable in said recess to spread said jaws apart.

20. The pencil defined in claim 9; further comprising respective forward and rearward abutments in said body engaging said tube in said forward and rearward positions.

21. The pencil defined in claim 20; further comprising a removable cap covering the rear end of said tube and forming therein a lead-storage compartment.

22. The pencil defined in claim 20, wherein said tube is provided with a front end piece formed with a throughgoing aperture longitudinally aligned with said passage and having a front end engageable with said jaws.

23. The pencil defined in claim 22; further comprising an annular seat member longitudinally displaceable in said body and forming said seat, and means frictionally longitudinally linking said front end piece and said seat member.

24. The pencil defined in claim 23, wherein said means longitudinally linking is a deformable ring between said seat member and said front end piece.

25. The pencil defined in claim 23, wherein said front end piece is formed with a rear face in turn formed at said hole with a backwardly flaring recess.

26. The pencil defined in claim 20, wherein said tube is provided with an outwardly projecting rim, said spring between said body and said tube engaging said rim.

* * * * *